US011530557B2

(12) United States Patent
Boyer

(10) Patent No.: US 11,530,557 B2
(45) Date of Patent: Dec. 20, 2022

(54) DUAL SWITCH ROTARY LATCH

(71) Applicant: Hartwell Corporation, Placentia, CA (US)

(72) Inventor: John J. Boyer, Placentia, CA (US)

(73) Assignee: HARTWELL CORPORATION, Placentia, CA (US)

( * ) Notice: Subject to any disclaimer, the term of this patent is extended or adjusted under 35 U.S.C. 154(b) by 491 days.

(21) Appl. No.: 16/599,718

(22) Filed: Oct. 11, 2019

(65) Prior Publication Data

US 2021/0108454 A1 Apr. 15, 2021

(51) Int. Cl.

| | |
|---|---|
| ***E05C 3/16*** | (2006.01) |
| ***E05B 39/00*** | (2006.01) |
| ***E05C 3/24*** | (2006.01) |

(52) U.S. Cl.

CPC ..... *E05C 3/162* (2013.01); *E05B 39/00* (2013.01); *E05C 3/24* (2013.01)

(58) Field of Classification Search

CPC ..... E05C 3/24; E05C 3/162; E05C 39/00
See application file for complete search history.

(56) References Cited

U.S. PATENT DOCUMENTS

| | | | |
|---|---|---|---|
| 2,710,214 | A | 6/1955 | Mills |
| 2,722,445 | A | 11/1955 | Cudney |
| 3,070,395 | A | 12/1962 | Morrison et al. |
| 3,194,595 | A | 7/1965 | Wheeler et al. |
| 3,279,836 | A | 10/1966 | Swanson |
| 4,069,696 | A | 1/1978 | Steinbach |
| 4,307,905 | A | 12/1981 | Poe et al. |
| 4,638,649 | A | 1/1987 | Chao |
| 4,736,174 | A | 4/1988 | Castonguay et al. |
| 4,743,052 | A | 5/1988 | Stammreich et al. |
| 4,911,485 | A | 3/1990 | Wasilewski |
| 4,925,221 | A | 5/1990 | Carmody et al. |
| 4,934,164 | A | 6/1990 | Shew |
| 5,201,557 | A | 4/1993 | Schlack |
| 5,257,839 | A | 11/1993 | Nielsen |
| 5,454,239 | A | 10/1995 | Esaki et al. |
| 5,638,709 | A | 6/1997 | Clavin |
| 5,765,883 | A | 6/1998 | Dessenberger et al. |
| 5,984,382 | A | 11/1999 | Bourne |
| 6,174,007 | B1 | 1/2001 | Schlack |
| 6,513,841 | B1 | 2/2003 | Jackson |
| 6,913,297 | B2 | 7/2005 | Jackson et al. |
| 7,185,926 | B2 * | 3/2007 | Helsley ..... E05C 19/14 292/113 |

(Continued)

*Primary Examiner* — Mark A Williams
(74) *Attorney, Agent, or Firm* — Barnes & Thornburg LLP

(57) ABSTRACT

A rotary latch mechanism for releasably securing a first structure relative to a second structure. The rotary latch mechanism includes a housing adapted to be attached to the first structure, an actuator assembly coupled to the housing, a linkage coupled to the actuator assembly and arranged for movement along the housing with movement of the actuator assembly, and a bolt coupled to the housing and to the linkage, the bolt arranged for pivotal movement relative to the housing with movement of the linkage. The bolt is adapted to move between a latched position engaged with the second structure to secure the first structure relative to the second structure and an unlatched position spaced apart from the second structure to allow movement of the first structure relative to the second structure.

20 Claims, 7 Drawing Sheets

(56) References Cited

U.S. PATENT DOCUMENTS

| | | | | |
|---|---|---|---|---|
| 7,503,600 | B2 | 3/2009 | Hautala et al. | |
| 8,186,728 | B2 | 5/2012 | Kopylov | |
| 8,356,844 | B2 * | 1/2013 | Baic | E05B 65/006 292/DIG. 31 |
| 8,419,088 | B2 * | 4/2013 | Baic | E05C 3/06 292/DIG. 31 |
| 8,544,900 | B2 * | 10/2013 | Elbrecht | E05C 3/048 292/202 |
| 8,646,819 | B2 * | 2/2014 | Do | B64D 29/06 292/228 |
| 8,720,237 | B2 | 5/2014 | Williams | |
| 9,169,678 | B2 * | 10/2015 | Rozema | E05B 51/023 |
| 2002/0195827 | A1 | 12/2002 | Jackson et al. | |
| 2006/0214431 | A1 * | 9/2006 | Helsley | B64D 29/06 292/113 |
| 2009/0134637 | A1 * | 5/2009 | Baic | E05C 3/048 292/205 |
| 2015/0184543 | A1 | 7/2015 | Fabre et al. | |
| 2015/0184544 | A1 | 7/2015 | Fabre et al. | |
| 2021/0108454 | A1 * | 4/2021 | Boyer | E05B 39/00 |

* cited by examiner

DUAL SWITCH ROTARY LATCH

FIELD OF THE DISCLOSURE

The present disclosure relates generally to a latch, and specifically to a rotary latch mechanism for use on aircraft. More specifically, the present disclosure relates to a rotary latch mechanism for releasably securing a first structure relative to a second structure on an aircraft.

BACKGROUND

A variety of latches are used on aircraft to retain various components of the aircraft in a locked condition under circumstances such as flight and storage of the aircraft. During maintenance or repair periods the latches must operate to unlock the corresponding panel, cowling, or other device. For example, the latch on a cowling can be disengaged to allow the cowling to be opened away from the engine components which it houses. The cowling, once opened, allows the aircraft maintenance professional to access the engine components. At the end of the repair event the cowling is closed. The latch is used to lock the cowling in the closed condition around the engine components in the housing.

As an additional matter, the maintenance professional may use a device to "clip" the latches closed to keep them from projecting out from the aircraft body or housing. The latches are clipped in a closed or lower profile position to prevent the latches from becoming bumped or from bumping the maintenance professional. Clipping the latches does not necessarily close or lock the latch but allows the latch to be maintained in a much lower profile against the aircraft housing or body. However, clipped latches can inadvertently appear to be locked and as such may fail to be locked. Additionally, even if the latches are operated to attempt to lock them a potential issue with the rotary latch mechanism might interfere with complete locking and as such could inadvertently unlatch during operation. It would be desirable to develop a system and assembly to be used with a latch to help provide assurances that the latch will, in fact, be closed and locked in the proper position.

This background information is merely for context and no admission is intended, nor should such admission be inferred or construed, that any of the preceding information constitutes prior art against the present disclosure.

SUMMARY

In accordance with embodiments of the present disclosure, a rotary latch mechanism is provided for releasably securing a first structure relative to a second structure. The rotary latch mechanism includes a housing adapted to be attached to the first structure, an actuator assembly coupled to the housing, a linkage coupled to the actuator assembly and arranged for movement along the housing with movement of the actuator assembly, and a bolt coupled to the housing and to the linkage, the bolt arranged for pivotal movement relative to the housing with movement of the linkage. The bolt is adapted to move between a latched position engaged with the second structure to secure the first structure relative to the second structure and an unlatched position spaced apart from the second structure to allow movement of the first structure relative to the second structure.

In illustrative embodiments, a first sensor is coupled to the housing and arranged for operation by the handle, and the first sensor is configured to provide a signal indicating whether the handle is in the locked or unlocked position. A second sensor is coupled to the housing and arranged for operation by the linkage, and the second sensor is configured to provide a signal indicating whether the bolt is in the latched or unlatched position.

In illustrative embodiments, a recess extends into the housing and is adapted to receive at least a portion of the handle with the handle in the locked position. The handle engages with the housing in the locked position to block pivoting movement of the handle and the column about the first pivot axis.

In illustrative embodiments, a trigger is coupled to the housing in the recess, and the trigger engages with the handle in the locked position to block pivoting movement of the handle about the second pivot axis at the selection of a user.

In illustrative embodiments, a clip is positioned in the recess for engagement by the handle in the locked position, and the clip engages with the first sensor in response to the handle moving to the locked position to operate the first sensor for providing a signal indicating that the handle is in the locked position.

In illustrative embodiments, a cavity is formed into the housing and a hole is arranged in the recess extending into the cavity. The clip engages with the first sensor through the hole.

In illustrative embodiments, a plate is coupled to the housing with the driver positioned between the plate and the housing. The second sensor is coupled to the plate, and an arm extends toward the linkage for engagement by the linkage in response to the bolt moving to the latched position such that the arm engages with the second sensor to operate the second sensor for providing a signal indicating that the bolt is in the latched position.

In illustrative embodiments, the column of the actuator assembly includes a post and a driver coupled to the post for pivoting movement with the post relative to the housing. The handle is coupled to the post for pivoting movement of the post with the handle, and the driver is configured to engage with the linkage with pivoting movement of the post for movement of the linkage relative to the housing.

In illustrative embodiments, a biasing mechanism is coupled to the housing and to the post. The biasing mechanism is configured to engage with the post to bias the bolt toward the latched position with the bolt in the latched position and to bias the bolt toward the unlatched position with the bolt in the unlatched position.

In illustrative embodiments, the biasing mechanism includes a hub coupled to the post, a shaft coupled to the housing, a guide coupled to the hub and extending toward the shaft, and a biasing member mounted on the guide. The biasing member engages with the guide and the shaft to bias the guide away from the shaft.

In illustrative embodiments, the hub is positioned on an opposite side of the plate from the driver.

In illustrative embodiments, a block extends from the plate away from the housing and is arranged for engagement with the hub to limit pivoting movement of the post about the first pivot axis.

In illustrative embodiments, a set screw extends from the block and is arranged for engagement with the hub to adjustably limit pivoting movement of the post about the first pivot axis.

In illustrative embodiments, the housing is formed to define a groove, and a projection extends from the linkage toward the housing and into the groove. The projection is arranged to move along the groove with movement of the linkage and engage with the housing to limit movement of the linkage relative to the housing.

In illustrative embodiments, the first sensor is coupled to the housing with a connector. The connector includes a fastener and an adjuster. The fastener extends through the adjuster, and the adjuster is configured to engage with the housing and move the fastener and the first sensor relative to the housing with rotation of the adjuster.

In illustrative embodiments, the adjuster includes a body, a projection extending from the body, and a receiver extending through the projection. The fastener extends through the receiver, and the receiver is offset from a central axis of rotation of the projection for movement of the fastener relative to the housing with rotation of the adjuster.

In accordance with embodiments of the present disclosure, a rotary latch mechanism is provided having a housing, an actuator assembly coupled to the housing, a linkage coupled to the actuator assembly, and a bolt coupled to the housing and to the linkage. The actuator assembly includes a column arranged for pivotal movement about a first pivot axis relative to the housing and a handle coupled to the column and arranged pivotal movement about a second pivot axis relative to the column. The handle is movable between a locked position secured against pivoting movement relative to the housing and an unlocked position for pivoting movement relative to the housing about the first pivot axis with the column. The linkage is arranged for movement along the housing with pivoting movement of the column about the first pivot axis. The bolt is arranged for pivotal movement about a third pivot axis relative to the housing with movement of the linkage between a latched position and an unlatched position. The housing is formed to define a groove and a projection extends from the linkage toward the housing and into the groove. The projection is arranged to move along the groove with movement of the linkage and engage with the housing to limit movement of the linkage relative to the housing.

In illustrative embodiments, a plate is coupled to the housing. The driver is positioned between the plate and the housing. The second sensor is coupled to the plate and an arm extends toward the linkage for engagement by the linkage in response to the bolt moving to the latched position such that the arm engages with the second sensor to operate the second sensor for providing a signal indicating that the bolt is in the latched position.

In illustrative embodiments, a biasing mechanism is coupled to the housing and to the column. The biasing mechanism is configured to engage with the column to bias the bolt toward the latched position with the bolt in the latched position and to bias the bolt toward the unlatched position with the bolt in the unlatched position.

In illustrative embodiments, the biasing mechanism includes a hub coupled to the column, a shaft coupled to the housing, a guide coupled to the hub and extending toward the shaft, and a biasing member mounted on the guide. The biasing member engages with the guide and the shaft to bias the guide away from the shaft.

In illustrative embodiments, the linkage includes a cage and a link coupled between the cage and the bolt. The projection extends from the cage into the groove, and the projection is configured to engage with the housing to block rotation of the cage relative to the housing.

BRIEF DESCRIPTION OF THE DRAWINGS

The present disclosure will be described hereafter with reference to the attached drawings which are given as a non-limiting example only, in which.

Figure 1:
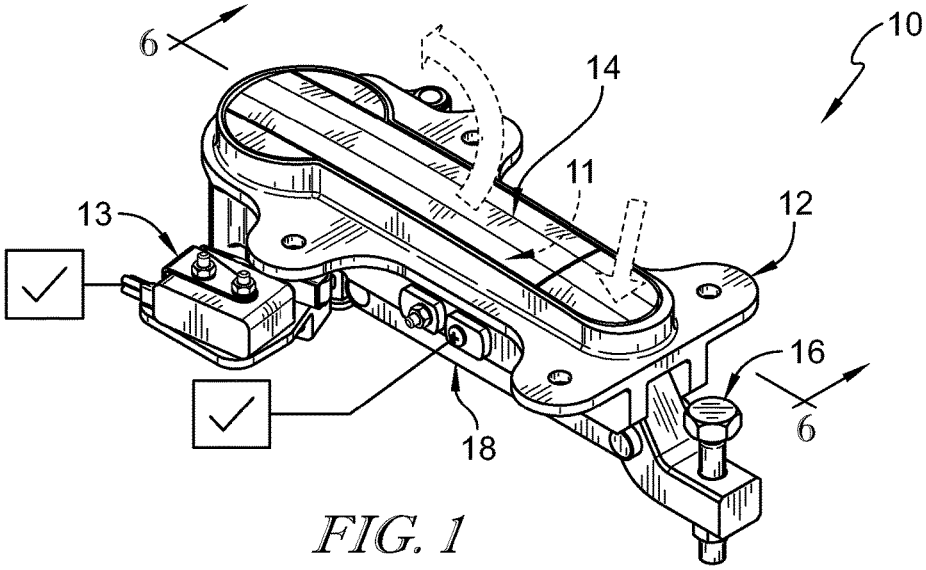
FIG. 1 is a perspective view of one embodiment of a rotary latch mechanism in accordance with the present disclosure showing that the rotary latch mechanism includes a housing, an actuator assembly coupled to the housing, a bolt coupled to the housing, and a linkage coupled between the actuator assembly and the bolt and suggesting that first and second sensors of the latch assembly indicate that the rotary latch mechanism is in a latched and locked position.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying modes of carrying out the disclosure as presently perceived.

DETAILED DESCRIPTION

An illustrative rotary latch mechanism 10 in accordance with the present disclosure is shown in FIGS. 1-4. Rotary latch mechanism 10 includes a housing 12, an actuator assembly 14 coupled to housing 12, a bolt 16 coupled to housing 12, and a linkage 18 coupled between actuator assembly 14 and bolt 16. Rotary latch mechanism 10 is shown in a latched and locked position in FIG. 1. Movement of actuator assembly 14 relative to housing 12 moves bolt 16, through linkage 18, relative to housing 12 as suggested in FIGS. 2 and 3. Rotary latch mechanism 10 can be mounted on a first structure 102 (such as a door panel of an aircraft) and selectively engage with a second structure 104 (such as a doorway of the aircraft) to block or allow movement of first structure 102 relative to second structure 104 as suggested in FIGS. 6, 8, and 9.

Figure 2:
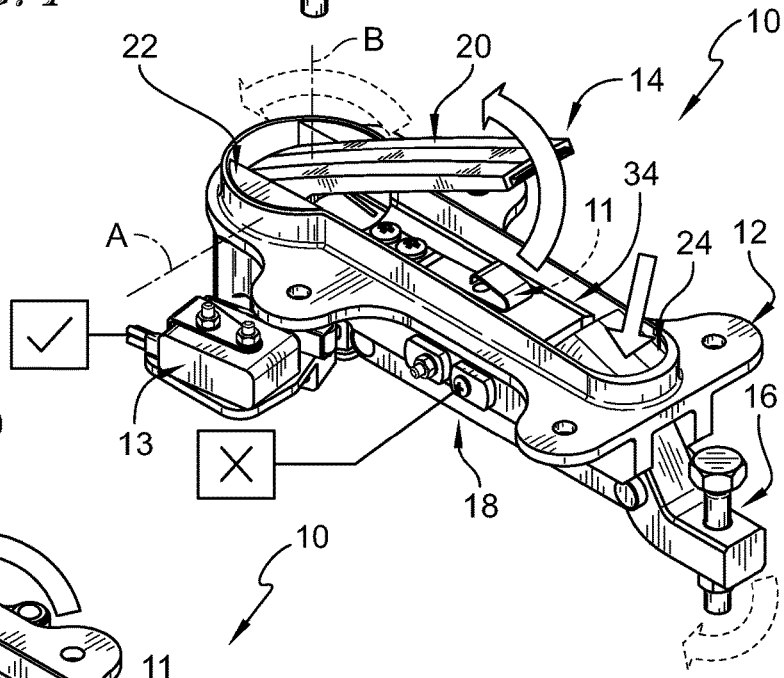
FIG. 2 is a view similar to FIG. 1 showing a handle of the actuator assembly displaced from a recess in the housing and suggesting that the first sensor indicates that the rotary latch mechanism is unlocked.
Figure 3:
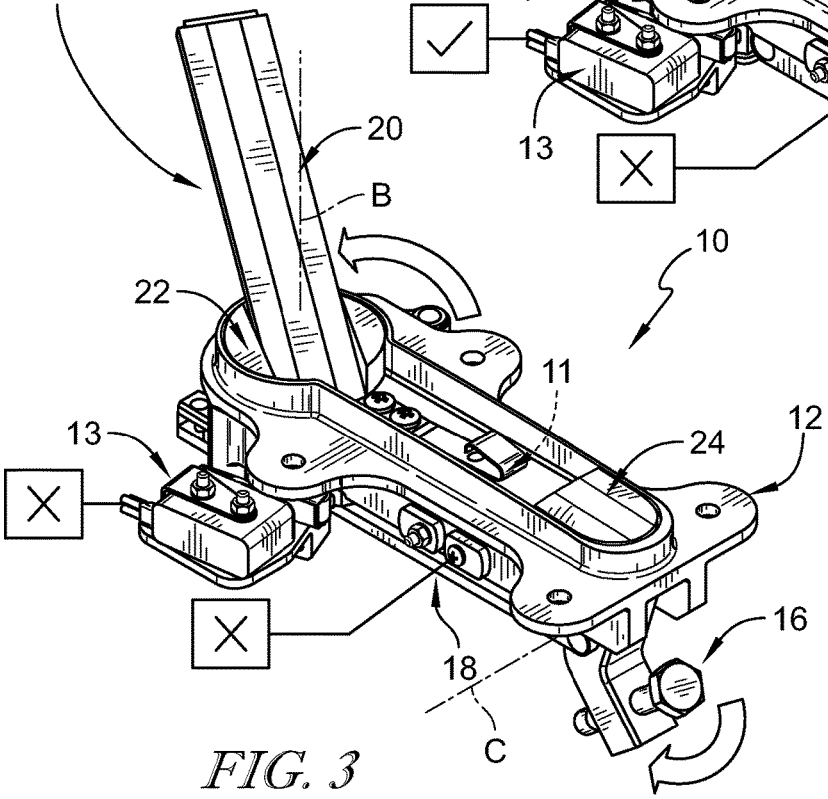
FIG. 3 is a view similar to FIG. 2 showing the handle rotated relative to the housing for movement of the bolt through the linkage and suggesting that the first and second sensors indicate that the rotary latch mechanism is in an unlatched position.
Figure 6:
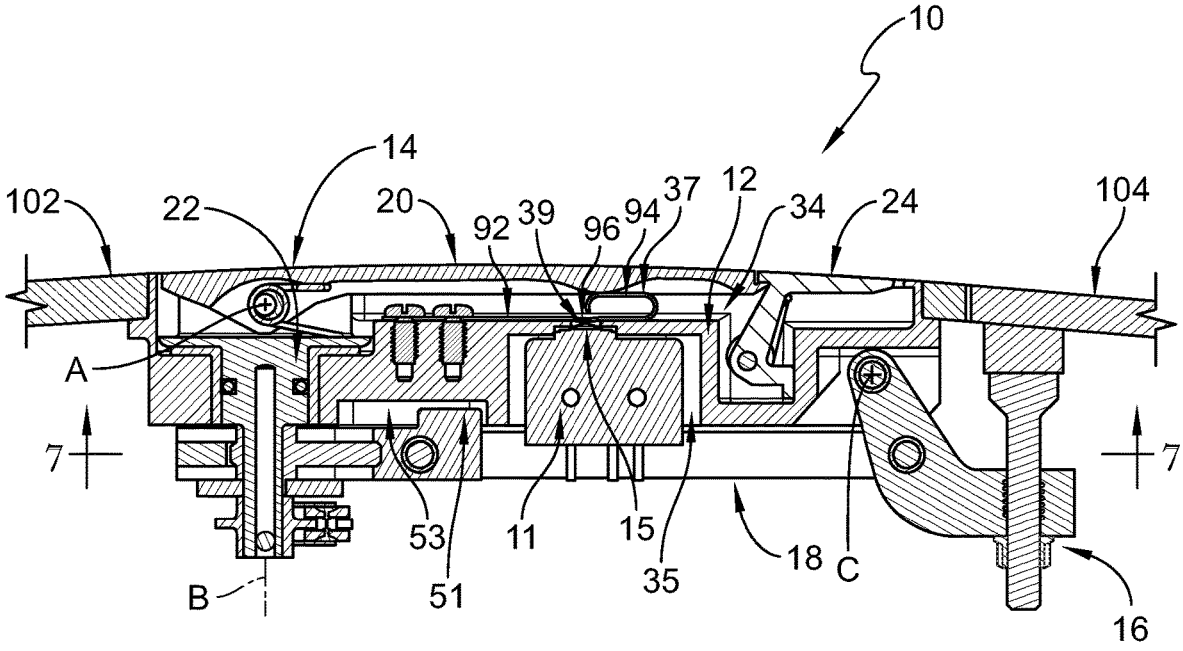
FIG. 6 is a sectional view taken along line 6-6 in FIG. 1 showing the rotary latch mechanism mounted on a first structure and the bolt engaged with a second structure to hold the first structure relative to the second structure and suggesting that the handle of the actuator assembly operates the first sensor for signaling that the rotary latch mechanism is in the locked position.
Figure 7:
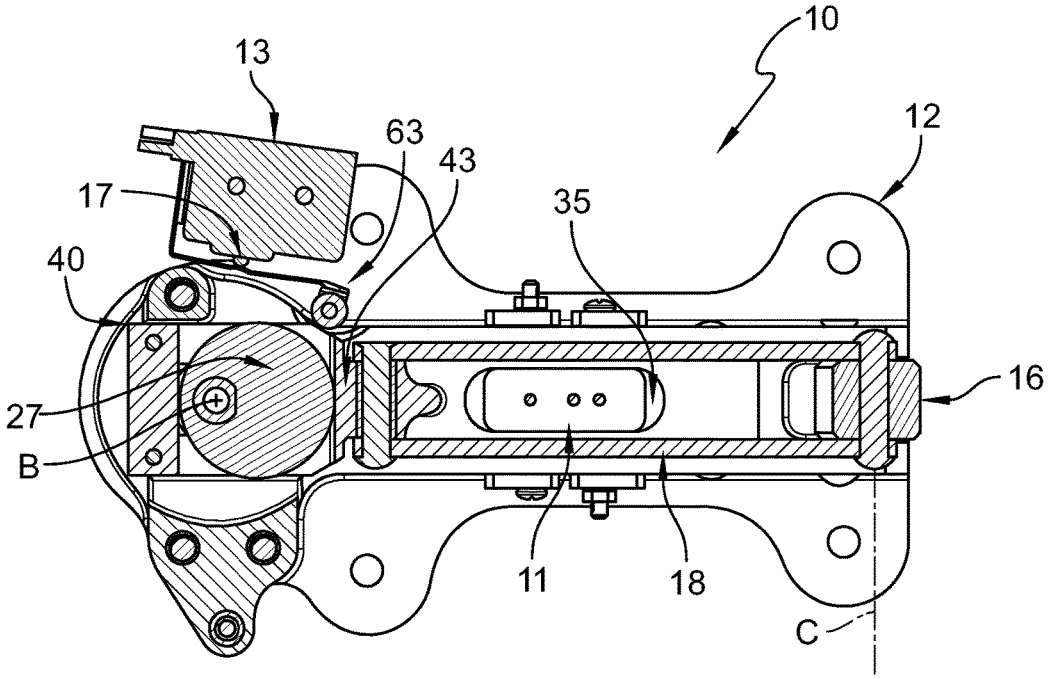
FIG. 7 is a sectional view taken along line 7-7 in FIG. 6 showing the actuator assembly engaged with the linkage to hold the bolt relative to the housing and suggesting that the linkage operates the second sensor for signaling that the rotary latch mechanism is in the latched position.
Figure 8:
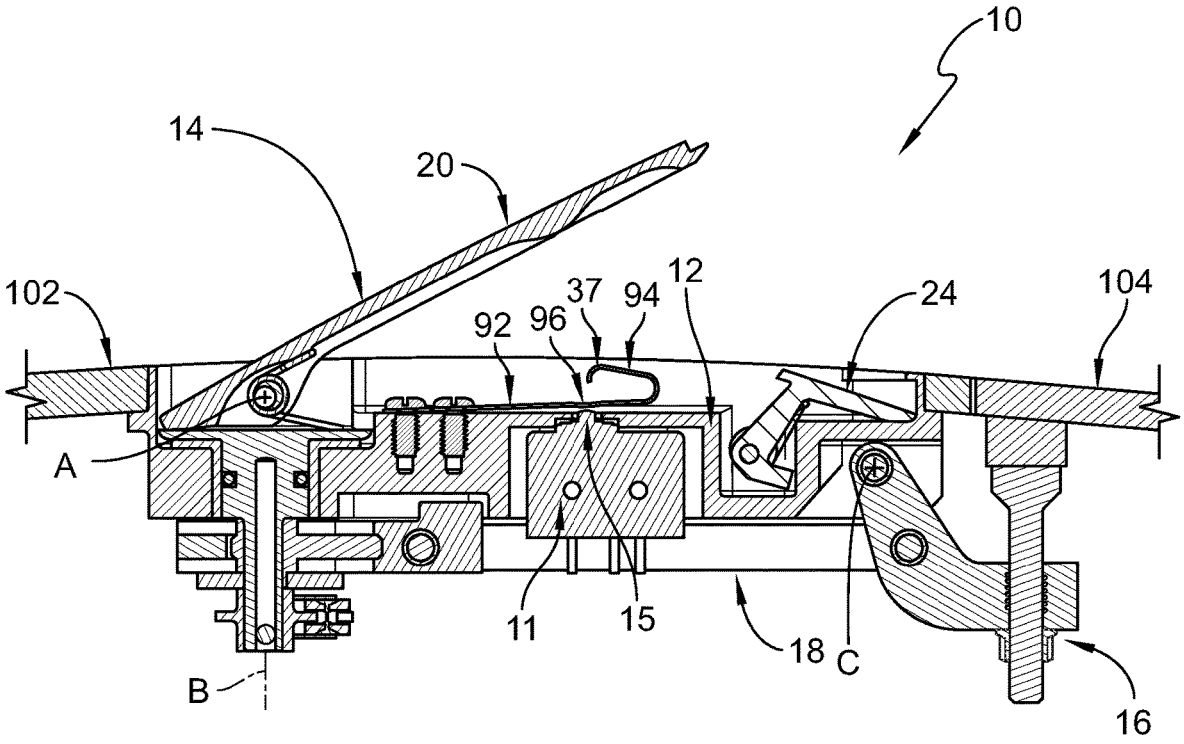
FIG. 8 is a view similar to FIG. 6 showing the handle moved away from the first sensor during unlocking of the rotary latch mechanism to signal that the rotary latch mechanism is unlocked.
Figure 10:
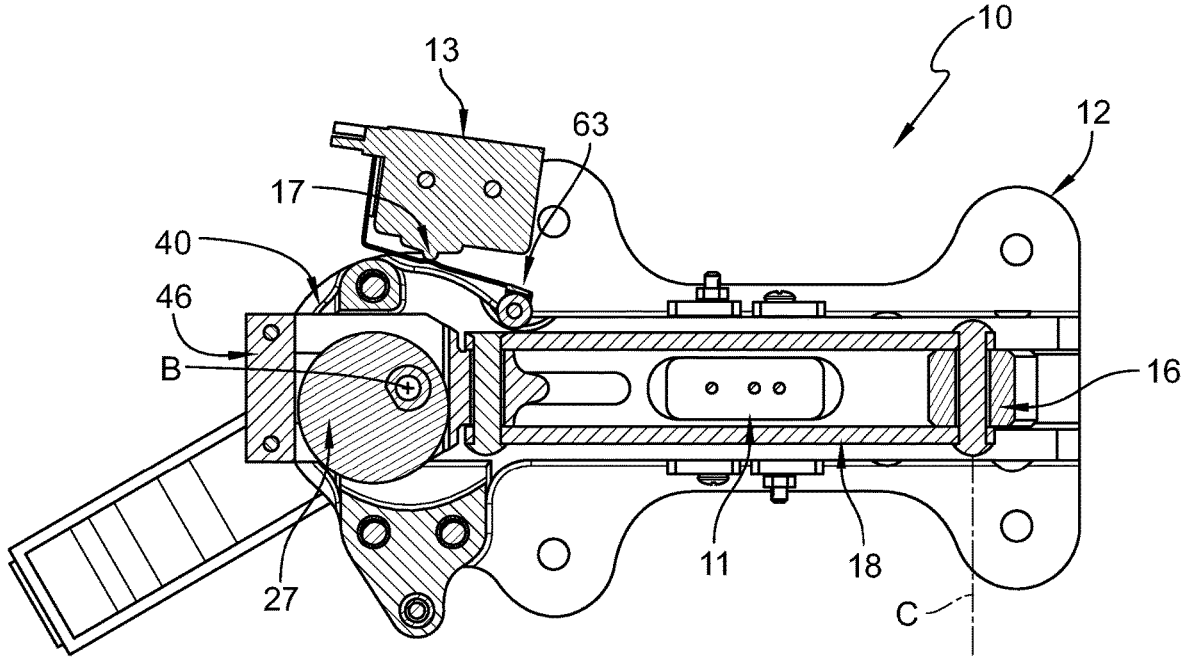
FIG. 10 is a sectional view taken along line 10-10 in FIG. 9 showing the linkage moved away from the second sensor during unlatching of the rotary latch mechanism to signal that the rotary latch mechanism is in the unlatched position.

A first sensor 11 is coupled to housing 12 and arranged for operation by actuator assembly 14 for signaling whether rotary latch mechanism 10 is in the locked position or in an unlocked position as shown in FIGS. 2, 6, and 8. A second sensor 13 is coupled to housing 12 and arranged for operation by linkage 18 for signaling whether rotary latch mechanism 10 is in the latched position or in an unlatched position as shown in FIGS. 3, 7, and 10. The use of multiple sensors 11, 13 in the illustrative rotary latch mechanism 10 increases safety and reliability. For example, the combination of sensors 11, 13 provides indication that rotary latch mechanism 10 is both latched and locked. In some embodiments, a plurality of rotary latch mechanisms 10 are used to secure the first structure 102 relative to second structure 104. In some embodiments, a first portion of the plurality of rotary latch mechanisms 10 include sensors 11, 13, and a second portion of the plurality of rotary latch mechanisms 10 does not include sensors 11, 13 (e.g., for cost savings).

In the illustrative embodiment, actuator assembly 14 includes a handle 20 and a column 22 as shown in FIGS. 2-10. Handle 20 is movable relative to column 22 about an axis A (a first pivot axis) for movement relative to a recess 34 formed in housing 12 as suggested in FIGS. 1 and 2. A trigger 24 engages with handle 20 to hold handle 20 in the locked position (FIGS. 1 and 6) at the selection of a user. Handle 20 and column 22 are movable together about an axis B (a second pivot axis) as suggested in FIGS. 2 and 3. Column 22 engages with linkage 18 for movement of linkage 18 along housing 12, and linkage 18 moves bolt 16 about an axis C (a third pivot axis), with movement of handle 20 and column 22 about axis B as suggested in FIGS. 2, 3, and 6-10.

Figure 4:
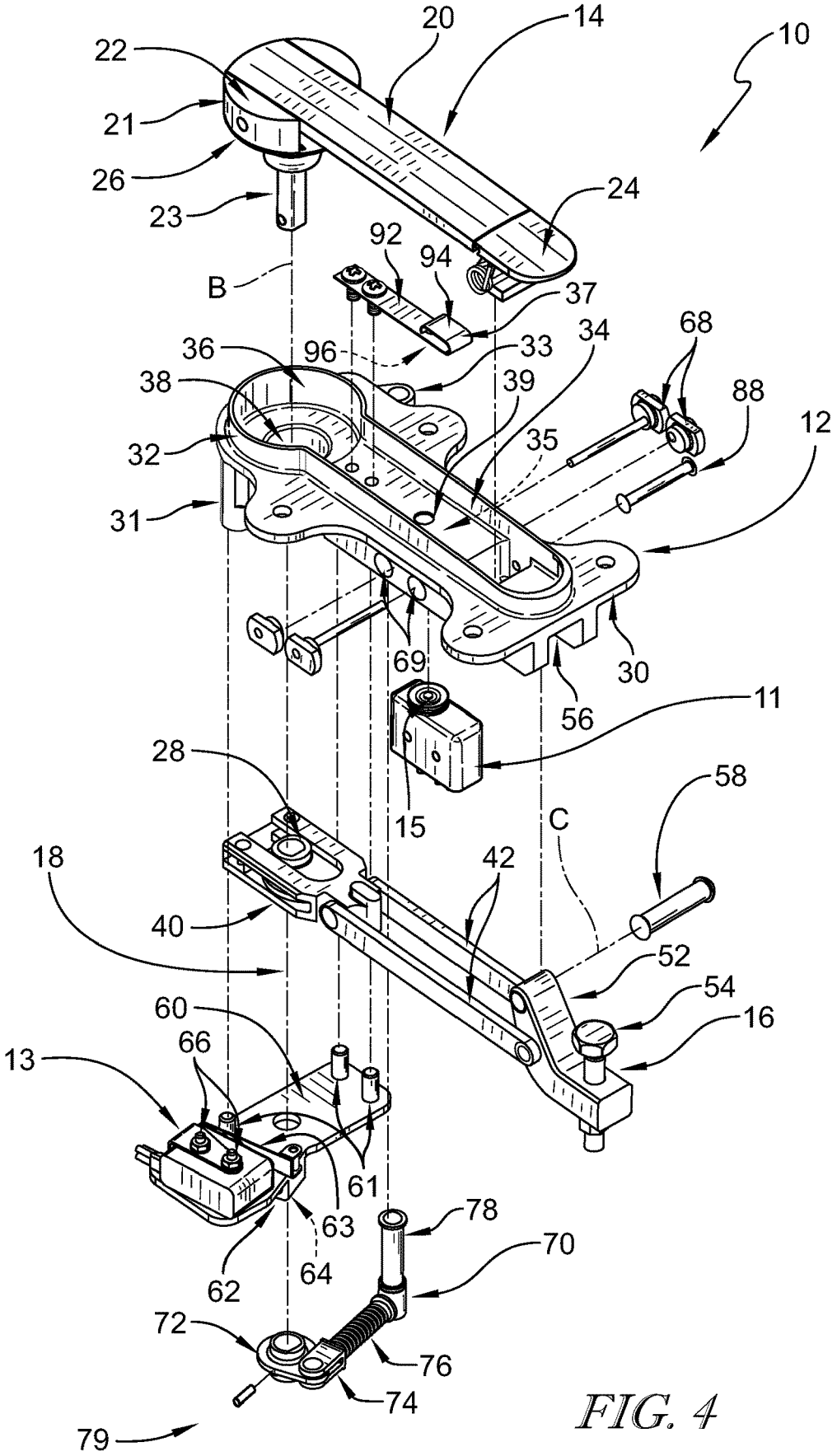
FIG. 4 is an exploded perspective assembly view of the rotary latch mechanism of FIG. 1.
Figure 5:
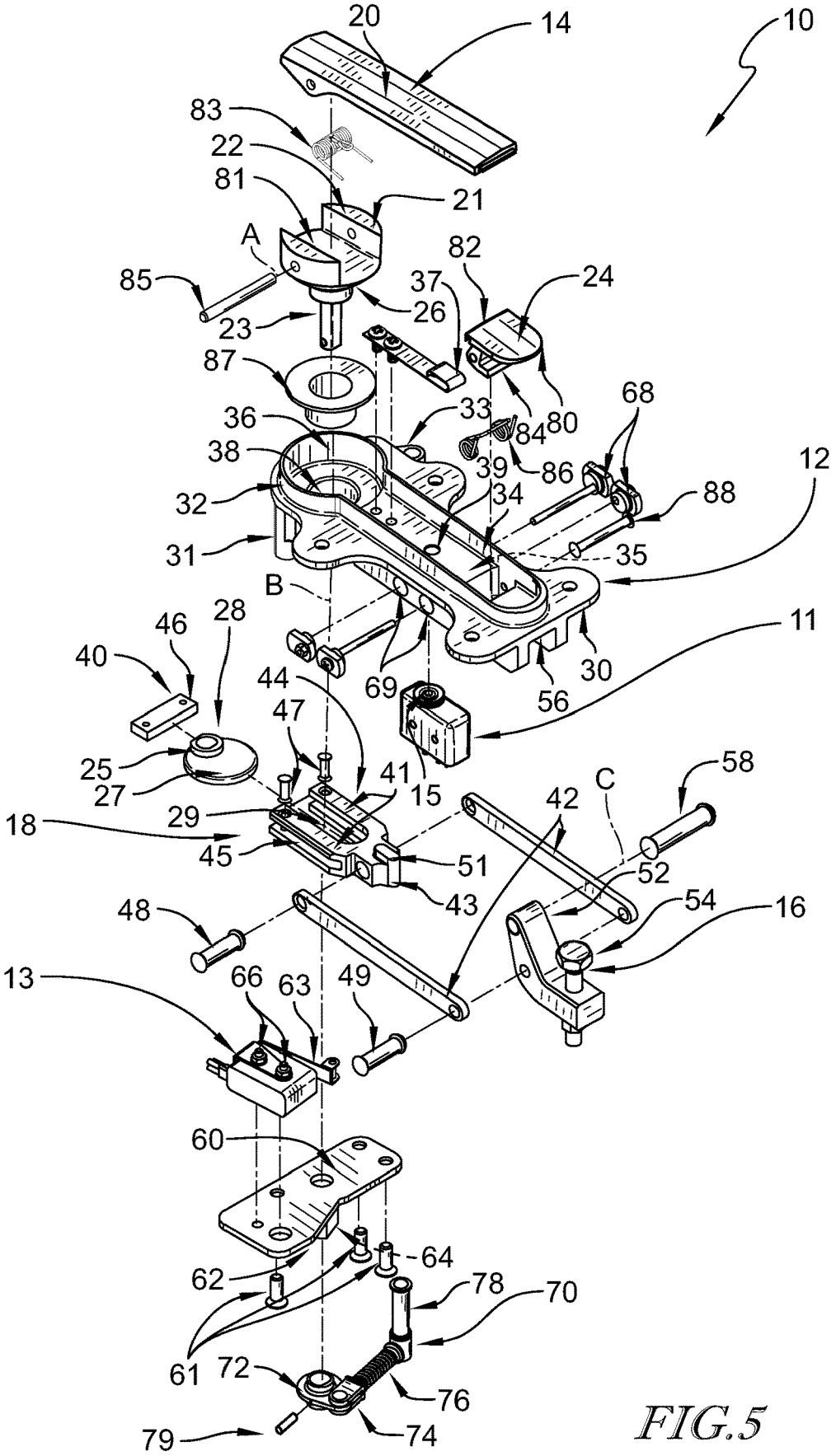
FIG. 5 is a further exploded perspective assembly view of the rotary latch mechanism of FIG. 4.

Column 22 includes a post 26 and a driver 28 as shown in FIGS. 4 and 5. Post 26 includes a body 21 and a stem 23 extending from body 21. Handle 20 is coupled to body 21 for movement with post 26 about axis B. Driver 28 is coupled to stem 23 for movement with post 26 and handle 20. Driver 28 includes a receiver 25 and a cam 27 coupled to receiver 25. In the illustrative embodiment, stem 23 of post 26 extends into receiver 25 of driver 28, and each of stem 23 and receiver 25 is formed with a corresponding, non-circular profile to block rotation of driver 28 relative to post 26. In some embodiments, a fastener engages with driver 28 and post 26 to block rotation of driver 28 relative to post 26 in addition or alternative to the non-circular profiles of receiver 25 and stem 23. In the illustrative embodiment, cam 27 is formed with a substantially circular profile, and receiver 25 is positioned eccentric relative to cam 27 for movement of cam 27 around axis B to drive movement of linkage 18 as further detailed below.

Housing 12 includes a mounting member 30, a retaining wall 32 extending from mounting member 30, and first and second pillars 31, 33 extending from mounting member 30 opposite of retaining wall 32 as shown in FIGS. 4 and 5. A recess 34 extends into housing 12 to receive handle 20 and trigger 24 and is at least partly defined by retaining wall 32. Handle 20 engages with retaining wall 32 in the locked position to block rotation about axis B. Handle 20 is clear of retaining wall 32 in the unlocked position and free to move about axis B. A major bore 36 extends into housing 12 and is at least partly defined by retaining wall 32, and a minor bore 38 extends through housing 12 substantially concentric with major bore 36. Body 21 of post 26 extends into major bore 36 and engages with housing 12 while stem 23 extends through housing 12 to engage with the driver 28. In the illustrative embodiment, major bore 36 has a larger diameter than minor bore 38, and body 21 has a larger diameter than stem 23 and minor bore 38.

A cavity 35 is formed into housing 12 to receive first sensor 11 as shown in FIGS. 4-7. In the illustrative embodiment, first sensor 11 is a contact sensor having a plunger 15 movable between extended and retracted positions for operating first sensor 11. A spring clip 37 is coupled to housing 12 in recess 34 over a hole 39 extending into cavity 35 as shown in FIGS. 4-6. Plunger 15 of first sensor 11 is aligned with hole 39. Spring clip 37 includes an arm 92 secured at a first end to housing 12, a head 94 coupled to an opposite second end of arm 92. Arm 92 is formed to define a dome or button 96 extending from arm 92 toward housing 12. Handle 20 engages with head 94 of spring clip 37, and button 96 engages with plunger 15 to move plunger 15 to the retracted position (FIG. 6) to indicate that rotary latch mechanism 10 is locked. Handle 20 and spring clip 37 move away from plunger 15 during unlatching of rotary latch mechanism 10 to allow plunger 15 to move to the extended position (FIGS. 8 and 9) to indicate that rotary latch mechanism 10 is unlocked. In some embodiments, arm 92 and/or head 94 of clip 37 engages with housing 12 and handle 20 in the locked position to bias handle 20 toward the unlocked position. In some embodiments, handle 20 engages with plunger 15. Other types of sensors are contemplated by the present disclosure for use with rotary latch mechanism 10.

Linkage 18 includes a cage 40 and links 42 coupled between cage 40 and bolt 16 as shown in FIGS. 4 and 5. Cage 40 includes a fork 44 and a tie bar 46 coupled to fork 44 by fasteners 47 (such as rivets) as shown in FIG. 5. Fork 44 includes opposing sets of arms 41 extending from a nose 43. Opposing sets of arms 41 are separated by a slot 29. Driver 28 extends into fork 44 and is trapped relative to fork 44 by tie bar 46. Receiver 25 is positioned within slot 29 between opposing sets of arms 41. A slot 45 extends between each set of arms 41, and cam 27 extends into slot 45. Receiver 25 moves along slot 29 with movement of linkage 18 relative to housing 12, and cam 27 moves within slot 45 for engagement with nose 43 and tie bar 46 to drive movement of linkage 18 with movement of column 22 about axis B. Links 42 are coupled to nose 43 of fork 44 with a fastener 48 (such as a rivet) and to bolt 16 with a fastener 49 (such as a rivet). In some embodiments, a projection 51 on fork 44 extends into a groove 53 (FIGS. 6-10) of housing 12 and engages with housing 12 to limit movement of linkage 18 relative to housing 12. Projection 51 also engages with groove 53 to align cage 40 with housing 12. For example, engagement of projection 51 with groove 53 to block rotation of cage 40 relative to housing 12.

Bolt 16 includes a leg 52 and an engagement member 54 coupled to leg 52 as shown in FIGS. 4 and 5. Leg 52 extends into an indent 56 of housing 12 and is coupled to housing 12 with a fastener 58 (such as a rivet) arranged along axis C. Fastener 49 couples links 42 of linkage 18 to leg 52 and is offset from fastener 58 to drive movement of bolt 16 about axis C with movement of linkage 18 relative to housing 12. Engagement member 54 moves around axis C with movement of leg 52. In the illustrative embodiment, engagement member 54 is adjustable relative to leg 52. For example, in some embodiments, engagement member 54 is threadedly coupled to leg 52 to allow linear adjustment of engagement member 54.

Second sensor 13 is mounted on a plate 60 coupled to housing 12 with fasteners 61 (such as bolts or screws) extending into pillars 31, 33 as shown in FIGS. 4 and 5. In the illustrative embodiment, cage 40 and driver 28 are positioned between plate 60 and housing 12, and cage 40 engages with an arm 63 to operate second sensor 13. In some embodiments, second sensor 13 is a contact sensor having a plunger 17 movable between extended and retracted positions for operating second sensor 13. In the latched position of rotary latch mechanism 10, cage 40 engages with arm 63 to move plunger 17 to the retracted position (FIG. 7) to indicate that rotary latch mechanism 10 is latched. Linkage 18 moves relative to housing 12 during unlatching of rotary latch mechanism 10 and cage 40 disengages from arm 63 to allow plunger 17 to move to the extended position (FIG. 10) to indicate that rotary latch mechanism 10 is unlatched. In some embodiments, cage 40 engages with plunger 17. Other types of sensors are contemplated by the present disclosure for use with rotary latch mechanism 10.

Figure 11:
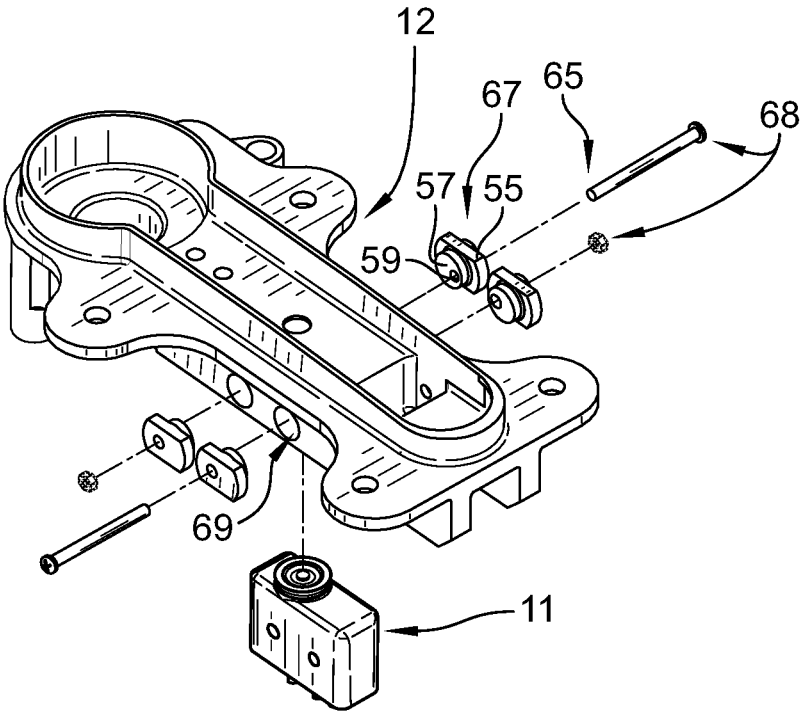
FIG. 11 is a perspective view of the housing of FIG. 4 showing connectors arranged to couple the first sensor to the housing and suggesting that the connectors allow adjustment of the first sensor relative to the housing.
Figure 12:
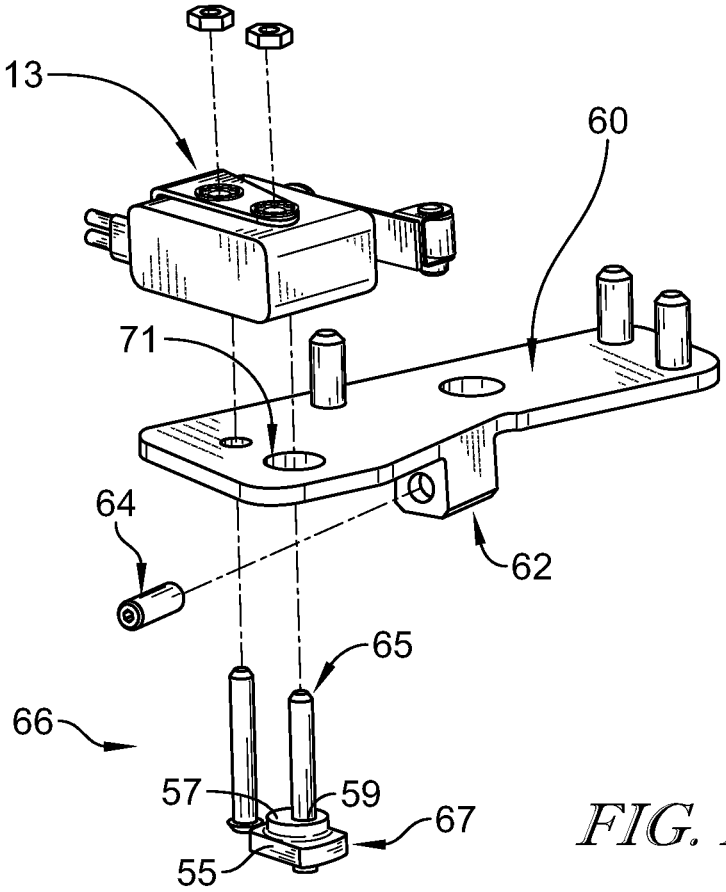
FIG. 12 is a perspective view of the second sensor of FIG. 4 showing connectors arranged to couple the second sensor to a plate coupled to the housing and suggesting that the connectors allow adjustment of the second sensor relative to the housing.

Connectors 66 couple second sensor 13 with plate 60 and connectors 68 couple first sensor 11 with housing 12 as shown in FIGS. 4, 5, 11, and 12. In the illustrated embodiment, connectors 66, 68 include a fastener 65 (such as screws or bolts and accompanying nuts) and an adjuster 67 as shown in FIGS. 11 and 12. Each adjuster 67 includes a body 55, a projection 57 extending from body 55, and a receiver 59 extending thorough projection 57. Projections 57 extend into openings 69, 71 in housing 12 and plate 60, respectively, and bodies 55 allow rotation of adjusters 67. Fasteners 65 extend through receivers 59, and receivers 59 are offset from a central axis of rotation of projections 57 to allow movement of fasteners 65 relative to housing 12 and plate 60 with rotation of adjusters 67. For example, rotation of adjusters 67 on connectors 68 moves fasteners 65 toward or away from hole 39 to allow movement of first sensor 11 toward or away from hole 39 in housing 12 for adjusting engagement of spring clip 37 with first sensor 11. In some embodiments, only one of connectors 68 includes an adjuster 67. In some embodiments, only one of connectors 66 includes an adjuster 67, and rotation of adjuster 67 drives rotation of second sensor 13 relative to plate 60 for adjusting engagement of cage 40 with second sensor 13. Fasteners 65 can be tightened to hold adjusters 67 against rotation and set the relative position of sensors 11, 13. Fasteners 65 of connectors 66, 68 also engage with sensors 11, 13 to hold sensors 11, 13 on housing 12 and plate 60, respectively.

A biasing mechanism 70 is coupled to housing 12 and configured to bias rotary latch mechanism 10 toward the latched and unlatched positions as suggested in FIGS. 4 and 5. Biasing mechanism 70 includes a hub 72, a guide 74, a biasing member 76 (such as a coil spring), and a shaft 78. Hub 72 is coupled to stem 23 of post 26 of actuator assembly 14 for rotation with post 26. In the illustrative embodiment, hub 72 is arranged on an opposite side of plate 60 from driver 28. Each of stem 23 and hub 72 is formed with a corresponding, non-circular profile to block rotation of hub 72 relative to post 26. In some embodiments, a fastener 79 (such as a pin, screw, or bolt) engages with hub 72 and post 26 to block rotation of hub 72 relative to post 26 in addition or alternative to the non-circular profiles of hub 72 and stem 23. Guide 74 is coupled to hub 72 and extends through biasing member 76 and shaft 78 for holding biasing member 76 on biasing mechanism 70. Shaft 78 is coupled to pillar 33 of housing 12. Biasing member 76 engages with guide 74 and shaft 78 to bias guide 74 away from shaft 78. In the latched position (FIG. 6), biasing mechanism 70 biases bolt 16, through actuator assembly 14 and linkage 18, toward the latched position. In the unlatched position (FIG. 9), biasing mechanism 70 biases bolt 16, through actuator assembly 14 and linkage 18, toward the unlatched position. In some embodiments, a block 62 extends from plate 60 away from housing 12 and is arranged to engage with hub 72 to limit movement of column 22 and handle 20 relative to housing 12 about axis B. In some embodiments, a set screw 64 (FIG. 12) extends from block 62 to engage with hub 72 and allow adjustment of the amount of rotation for column 22 and handle 20 relative to housing 12 about axis B.

Figure 9:
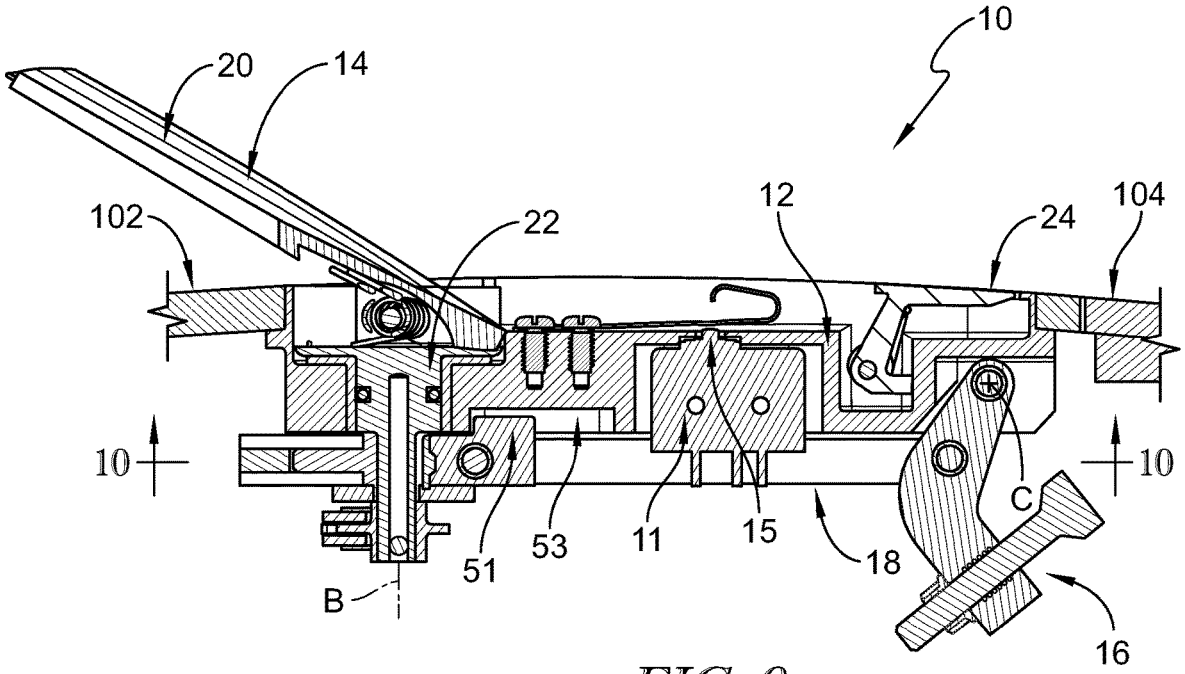
FIG. 9 is a view similar to FIG. 8 showing the rotary latch mechanism in the unlatched and unlocked position with the bolt displaced from the second structure to allow the first structure to move relative to the second structure.

As shown in FIG. 5, body 21 of post 26 is formed to define a slot 81. A biasing member 83 (such as a wound spring) and handle 20 are received in slot 81 and held on post 26 by a fastener 85 (such as a pin, screw, or bolt) arranged along axis A. Biasing member 83 biases handle 20 toward the unlocked position. In some embodiments, a sleeve 87 is coupled between post 26 and housing 12. Trigger 24 includes a button 80, a catch 82, and a foot 84. A fastener 88 extends into housing 12 to engage with a biasing member 86 (such as a wound spring) and trigger 24 to hold trigger 24 on housing 12 and allow movement of trigger 24 relative to housing 12. Catch 82 engages with handle 20 to hold handle 20 in the locked position at the selection of a user. Biasing member 86 biases catch 82 toward handle 20. Foot 84 engages with housing 12 to limit movement of trigger 24 relative to housing 12 as shown in FIG. 9. A user engages button 80 to move catch 82 away from handle 20 to allow handle 20 to move from the locked position to the unlocked position as shown in FIG. 8.

In the illustrative embodiment, rotary latch mechanism 10 is mounted on a first structure 102 (e.g., with fasteners extending through mounting member 30 into first structure 102) for movement with first structure 102 relative to a second structure 104 as shown in FIG. 6. Handle 20 and trigger 24 follow a contour of structures 102, 104 in the locked position (e.g., for improved aerodynamics). Engagement member 54 of bolt 16 engages with second structure 104 in the latched position to block movement of first structure 102 relative to second structure 104. Cam 27 of actuator assembly 14 engages with nose 43 of fork 44 of linkage 18 to hold bolt 16 in the latched position as shown in FIGS. 6 and 7. Bolt 16 is spaced apart from second structure 104 in the unlatched position (FIG. 9) to allow movement of first structure 102 relative to second structure 104.

Rotary latch mechanism 10 is shown in the latched and locked position in FIGS. 1, 6 and 7. To unlatch rotary latch mechanism 10, a user engages trigger 24 and moves handle 20 about axis A out of recess 34 to the unlocked position as shown in FIGS. 2 and 8. First sensor 11 indicates that handle 20 moved to the unlocked position. Rotary latch mechanism 10 remains latched until the user moves handle 20 about axis B away from recess 34, and cam 27 engages with tie bar 46 to move linkage 18 along housing 12 and move bolt 16 about axis C away from second structure 104 as shown in FIGS. 3, 9 and 10. Second sensor 13 indicates that linkage 18 and bolt 16 moved to the unlatched position. To latch rotary latch mechanism 10, the user moves handle 20 about axis B toward recess 34, and cam 27 engages with nose 43 of fork 44 to move linkage 18 along housing 12 and move bolt 16 about axis C toward second structure 104. Second sensor 13 indicates that linkage 18 and bolt 16 moved to the latched position. The user moves handle 20 about axis A into recess 34 to the locked position and trigger 24 engages with handle 20 to hold handle 20 in the locked position. First sensor 11 indicates that handle 20 moved to the locked position.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation to encompass all such modifications and equivalent structures and functions.

The invention claimed is:

1. A rotary latch mechanism for releasably securing a first structure relative to a second structure, the rotary latch mechanism comprising:

a housing adapted to be attached to the first structure;

an actuator assembly coupled to the housing, the actuator assembly including a column arranged for pivotal movement about a first pivot axis relative to the housing and a handle coupled to the column and arranged for pivotal movement about a second pivot axis relative to the column, the handle movable between a locked position in which the handle is trapped relative to the housing to block pivoting movement of the handle relative to the housing and an unlocked position in which the handle extends away from the housing to allow pivoting movement of the handle relative to the housing about the first pivot axis, the handle engages with the column to pivot the column about the first axis in response to pivoting movement of the handle relative to the housing about the first pivot axis;

a linkage coupled to the column, the linkage configured to move along the housing in response to pivoting movement of the column about the first pivot axis;

a bolt coupled to the housing and to the linkage, the bolt configured to pivot about a third pivot axis relative to the housing in response to movement of the linkage along the housing, the bolt arranged to move between a latched position engaged with the second structure to secure the first structure relative to the second structure and an unlatched position spaced apart from the second structure to allow movement of the first structure relative to the second structure;

a first sensor coupled to the housing and arranged for operation by the handle, the first sensor configured to provide a signal indicating whether the handle is in the locked or unlocked position; and a second sensor coupled to the housing and arranged for operation by the linkage, the second sensor configured to provide a signal indicating whether the bolt is in the latched or unlatched position.

2. The rotary latch mechanism of claim 1, wherein a recess extends into the housing and is adapted to receive at least a portion of the handle with the handle in the locked position, and wherein the handle engages with the housing in the locked position to block pivoting movement of the handle about the first pivot axis, and wherein the handle is configured to engage with the column in the locked position to block pivoting movement of the column about the first pivot axis.

3. The rotary latch mechanism of claim 2, wherein a trigger is coupled to the housing in the recess, and wherein the trigger engages with the handle in the locked position to block pivoting movement of the handle about the second pivot axis at the selection of a user.

4. The rotary latch mechanism of claim 2, wherein a clip is positioned in the recess for engagement by the handle in the locked position, and wherein the clip engages with the first sensor in response to the handle moving to the locked position to operate the first sensor for providing a signal indicating that the handle is in the locked position.

5. The rotary latch mechanism of claim 4, wherein a cavity is formed into the housing and a hole is arranged in the recess extending into the cavity, and wherein the clip engages with the first sensor through the hole.

6. The rotary latch mechanism of claim 1, further comprising a plate coupled to the housing, wherein the driver is positioned between the plate and the housing, wherein the second sensor is coupled to the plate, and wherein an arm extends from the second senor toward the linkage for engagement by the linkage in response to the bolt moving to the latched position to operate the second sensor for providing a signal indicating that the bolt is in the latched position.

7. The rotary latch mechanism of claim 1, wherein the column of the actuator assembly includes a post and a driver coupled to the post, wherein the handle is coupled to the post, wherein the driver and the post are arranged for pivoting movement about the first axis in response to pivoting movement of the handle relative to the housing about the first pivot axis, and wherein the driver is configured to engage with the linkage to move the linkage along the housing in response to pivoting movement of the column about the first axis.

8. The rotary latch mechanism of claim 7, further comprising a biasing mechanism coupled to the housing and to the post, wherein the biasing mechanism is configured to engage with the post to bias the linkage and the bolt toward the latched position with the bolt in the latched position and to bias the linkage and the bolt toward the unlatched position with the bolt in the unlatched position.

9. The rotary latch mechanism of claim 8, wherein the biasing mechanism includes a hub coupled to the post, a shaft coupled to the housing, a guide coupled to the hub and extending toward the shaft, and a biasing member mounted on the guide, and wherein the biasing member engages with the guide and the shaft to bias the guide away from the shaft.

10. The rotary latch mechanism of claim 9, further comprising a plate coupled to the housing, wherein the driver is positioned between the plate and the housing, and wherein the hub is positioned on an opposite side of the plate from the driver.

11. The rotary latch mechanism of claim 10, wherein a block extends from the plate away from the housing and is arranged for engagement with the hub to limit pivoting movement of the post about the first pivot axis.

12. The rotary latch mechanism of claim 11, wherein a set screw extends from the block and is arranged for engagement with the hub to adjustably limit pivoting movement of the post about the first pivot axis.

13. The rotary latch mechanism of claim 1, wherein the housing is formed to define a groove, wherein a projection extends from the linkage toward the housing and into the groove, and wherein the projection is arranged to move along the groove in response to movement of the linkage and to engage with the housing to limit movement of the linkage relative to the housing.

14. The rotary latch mechanism of claim 1, wherein the first sensor is coupled to the housing with a connector, wherein the connector includes a fastener and an adjuster, wherein the fastener extends through the adjuster, and wherein the adjuster is configured to engage with the housing and move the fastener and the first sensor relative to the housing in response to rotation of the adjuster.

15. The rotary latch mechanism of claim 14, wherein the adjuster includes a body, a projection extending from the body, and a receiver extending through the projection, wherein the fastener extends through the receiver, and wherein the receiver is offset from a central axis of rotation of the projection for movement of the fastener relative to the housing in response to rotation of the adjuster.

16. A rotary latch mechanism comprising:

a housing;

an actuator assembly coupled to the housing, the actuator assembly including a column arranged for pivotal movement about a first pivot axis relative to the housing and a handle coupled to the column and arranged for pivotal movement about a second pivot axis relative to the column, the handle movable between a locked position in which the handle is trapped relative to the housing to block pivoting movement of the handle relative to the housing and an unlocked position in which the handle extends away from the housing to allow pivoting movement of the handle relative to the housing about the first pivot axis, the handle engages with the column to pivot the column about the first axis in response to pivoting movement of the handle relative to the housing about the first pivot axis;

a linkage coupled to the column, the linkage configured to move along the housing in response to pivoting movement of the column about the first pivot axis, the linkage including a cage and an arm coupled to the cage and to the bolt;

a bolt coupled to the housing and to the linkage, the bolt configured to pivot about a third pivot axis relative to the housing in response to movement of the linkage along the housing, the bolt arranged to move between a latched position and an unlatched position, wherein the column of the actuator assembly includes a post and a driver coupled to the post, wherein the handle is coupled to the post, wherein the driver and the post are arranged for pivoting movement about the first axis in response to pivoting movement of the handle relative to the housing about the first pivot axis, wherein the linkage includes a cage and an arm coupled between the cage and to the bolt, wherein the driver is configured to engage with the cage to move the linkage along the housing in response to pivoting movement of the column about the first axis, wherein the housing is formed to define a groove, wherein a projection extends from the cage toward the housing and into the groove, and wherein the projection is arranged to move along the groove in response to movement of the linkage and to engage with the housing to limit movement of the linkage relative to the housing.

17. The rotary latch mechanism of claim 16, further comprising a plate coupled to the housing, wherein the driver is positioned between the plate and the housing, wherein a second sensor is coupled to the plate and arranged for operation by the linkage, wherein the second sensor is configured to provide a signal indicating whether the bolt is in the latched or unlatched position, and wherein an arm extends from the second senor toward the linkage for engagement by the linkage in response to the bolt moving to the latched position to operate the second sensor for providing a signal indicating that the bolt is in the latched position.

18. The rotary latch mechanism of claim 16, further comprising a biasing mechanism coupled to the housing and to the column, wherein the biasing mechanism is configured to engage with the column to bias the linkage and the bolt toward the latched position with the bolt in the latched position and to bias the linkage and the bolt toward the unlatched position with the bolt in the unlatched position.

19. The rotary latch mechanism of claim 18, wherein the biasing mechanism includes a hub coupled to the column, a shaft coupled to the housing, a guide coupled to the hub and extending toward the shaft, and a biasing member mounted on the guide, and wherein the biasing member engages with the guide and the shaft to bias the guide away from the shaft.

20. The rotary latch mechanism of claim 16, wherein the projection is configured to engage with the housing to block rotation of the cage relative to the housing.

* * * * *